US006282986B1

(12) United States Patent
Watson et al.

(10) Patent No.: US 6,282,986 B1
(45) Date of Patent: Sep. 4, 2001

(54) METHOD AND APPARATUS FOR REMOVING A CLOSURE FROM AN OPENING IN A DRUM LID

(75) Inventors: Grahame Watson; Bryan Alan Carter, both of Seven Hills; Chris Edward Bebb, Kings Park, all of (AU)

(73) Assignee: Van Leer Australia Pty. Limited, Seven Hills (AU)

( * ) Notice: Subject to any disclaimer, the term of this patent is extended or adjusted under 35 U.S.C. 154(b) by 0 days.

(21) Appl. No.: 09/462,710

(22) PCT Filed: Jul. 9, 1998

(86) PCT No.: PCT/AU98/00527

§ 371 Date: Apr. 17, 2000

§ 102(e) Date: Apr. 17, 2000

(87) PCT Pub. No.: WO99/02447

PCT Pub. Date: Jan. 21, 1999

(30) Foreign Application Priority Data

Jul. 9, 1997 (AU) ..... PO7799

(51) Int. Cl.[7] ..... B67B 7/00
(52) U.S. Cl. ..... 81/3.36; 81/3.07
(58) Field of Search ..... 81/3.07, 3.09, 81/3.36, 3.29; 7/151

(56) References Cited

U.S. PATENT DOCUMENTS

| | | | | |
|---|---|---|---|---|
| 1,263,207 | * | 4/1918 | Chase | 81/3.29 |
| 3,683,433 | * | 8/1972 | Massaro | 7/151 |
| 4,173,909 | * | 11/1979 | Cleveland et al. | 81/3.36 |
| 4,327,607 | * | 5/1982 | Morris | 81/3.36 |

FOREIGN PATENT DOCUMENTS

| | | |
|---|---|---|
| 35327/71 A | 1/1973 | (AU) . |
| 2583032A | 12/1986 | (FR) . |

OTHER PUBLICATIONS

Derwent Abstract Accession No: 89–247074, SU 1440868A (CIPROSTAL RES DES) Nov. 30, 1988 Abstract.

* cited by examiner

*Primary Examiner*—Joseph J. Hail, III
*Assistant Examiner*—Joni B. Danganan
(74) *Attorney, Agent, or Firm*—Knobbe, Martens, Olson & Bear, LLP

(57) ABSTRACT

A method and apparatus for removing a closure from a center-fill drum opening. The apparatus includes a clamping mechanism and a load transfer assembly coupled to the clamping mechanism and including a drive element engageable with the closure and movable relative to the clamping mechanism to force the closure inwardly of the drum. The assembly is arranged so that the element is eccentric with respect to the opening.

8 Claims, 4 Drawing Sheets

METHOD AND APPARATUS FOR REMOVING A CLOSURE FROM AN OPENING IN A DRUM LID

FIELD OF THE INVENTION

The present invention relates to a method and apparatus for removing a closure from an opening in a drum lid particularly, but not exclusively, a closure used to seal a "centre-fill" opening.

BACKGROUND OF THE INVENTION

It is known to provide a drum with a relatively large "centre-fill" opening formed centrally of a lid of the drum. The size of the opening allows for rapid filling of the drum and the central positioning provides for ready alignment of the opening with a suitable nozzle for a filling process. After filling the drum, a dish-like closure is fitted in the opening and swaged under the lid. The swaging is effective in drawing a peripheral lip of the closure down into sealing engagement with a corresponding shaped lip of the opening. Previously, such a seal was considered permanent. The contents of the drum were removed and, possibly refilled, using smaller peripheral openings formed in the drum.

It is an object of the invention to reuse a centre-fill drum by removing the closure from the centre opening.

SUMMARY OF THE INVENTION

In accordance with the invention there is provided an apparatus for removing a closure from an opening in a drum, including a clamping mechanism for securing the apparatus to the drum;

a load transfer assembly coupled to the clamping mechanism and including a drive element engageable with the closure and moveable relative to the clamping mechanism to force the closure inwardly of the drum, wherein the clamping mechanism is adapted to fit about a periphery of the opening, and the assembly is arranged so that the element is eccentric with respect to the opening.

Preferably the clamping mechanism includes two hinged components which are adapted to clamp underneath a peripheral lip of the opening.

Preferably the clamping mechanism includes a latch to releasably secure free ends of the components, when clamped in an operative position, about the opening.

Preferably the assembly includes slidable engagement with one of the components whereby to allow for free hinged movement of the components between an open condition and an operative condition.

Preferably the clamping mechanism includes at least one arcuate tapered jaw portion, adapted to fit under the peripheral lip of the opening.

Preferably the jaw portion is removable from the clamping mechanism so as to enable replacement thereof.

In another aspect there is provided a method for removing a closure from an opening in a drum, including fitting a clamping mechanism to the drum, exerting a compression force between the mechanism and the closure, eccentrically of the opening, so as to deform the closure inwardly of the drum.

Preferably, fitting the clamping mechanism to the drum includes clamping hinged components of the mechanism about a peripheral lip of the opening.

In another aspect, there is provided a method for removing a closure from an opening in a drum, utilising the above described apparatus.

BRIEF DESCRIPTION OF THE DRAWINGS

The invention is more fully described, by way of non-limiting example only, with reference to the accompanying drawings, in which.

DETAILED DESCRIPTION OF THE DRAWINGS

Figure 1:
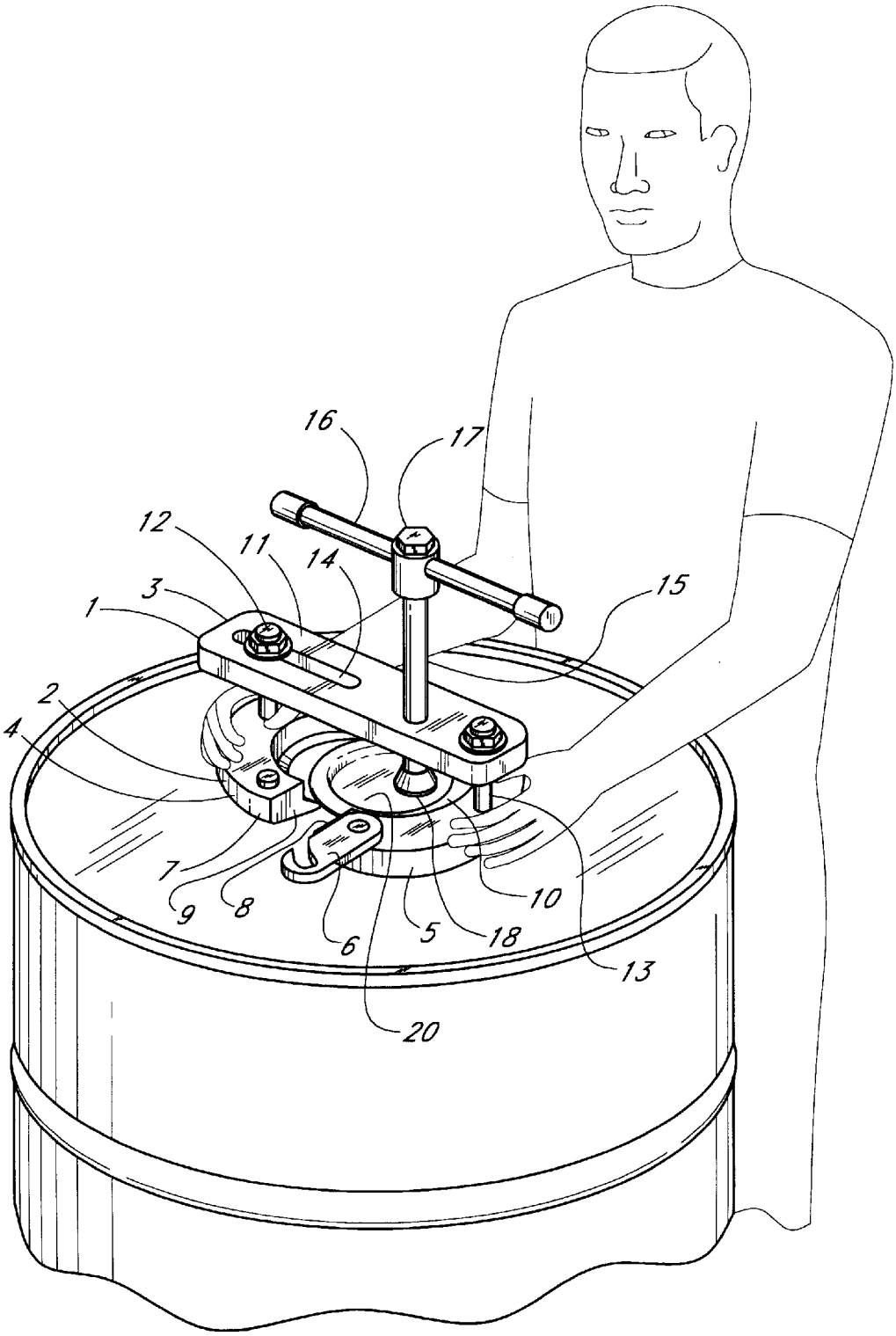
FIG. 1 is a perspective view of an apparatus being fitted for use.

The apparatus 1 includes a clamping mechanism 2 and a load transfer assembly 3. The clamping mechanism 2 includes two semi-circular components 4, 5 which are hinged together and include a latch 6 for releasably connecting the free ends 7, 8 of the components. Each component 4, 5 includes an arcuate, inwardly tapered, jaw portion 9, 10, which may be removable to facilitate replacement thereof.

The load transfer assembly 3 includes a beam 11 coupled to the clamping assembly 2 by bolts 12, 13. One of the bolts 12 is received in a longitudinal slot 14 of the beam 11 to allow for sliding movement therebetween, resulting from hinged movement of the components of the clamping mechanism from an open condition shown in FIG. 1 to an operative condition, shown in FIG. 2. The assembly 3 includes a rotatable shaft 15 threadably connected with the beam 11. The shaft has a turn handle 16 at one end 17 and element 18 at the other end thereof.

Figure 2:
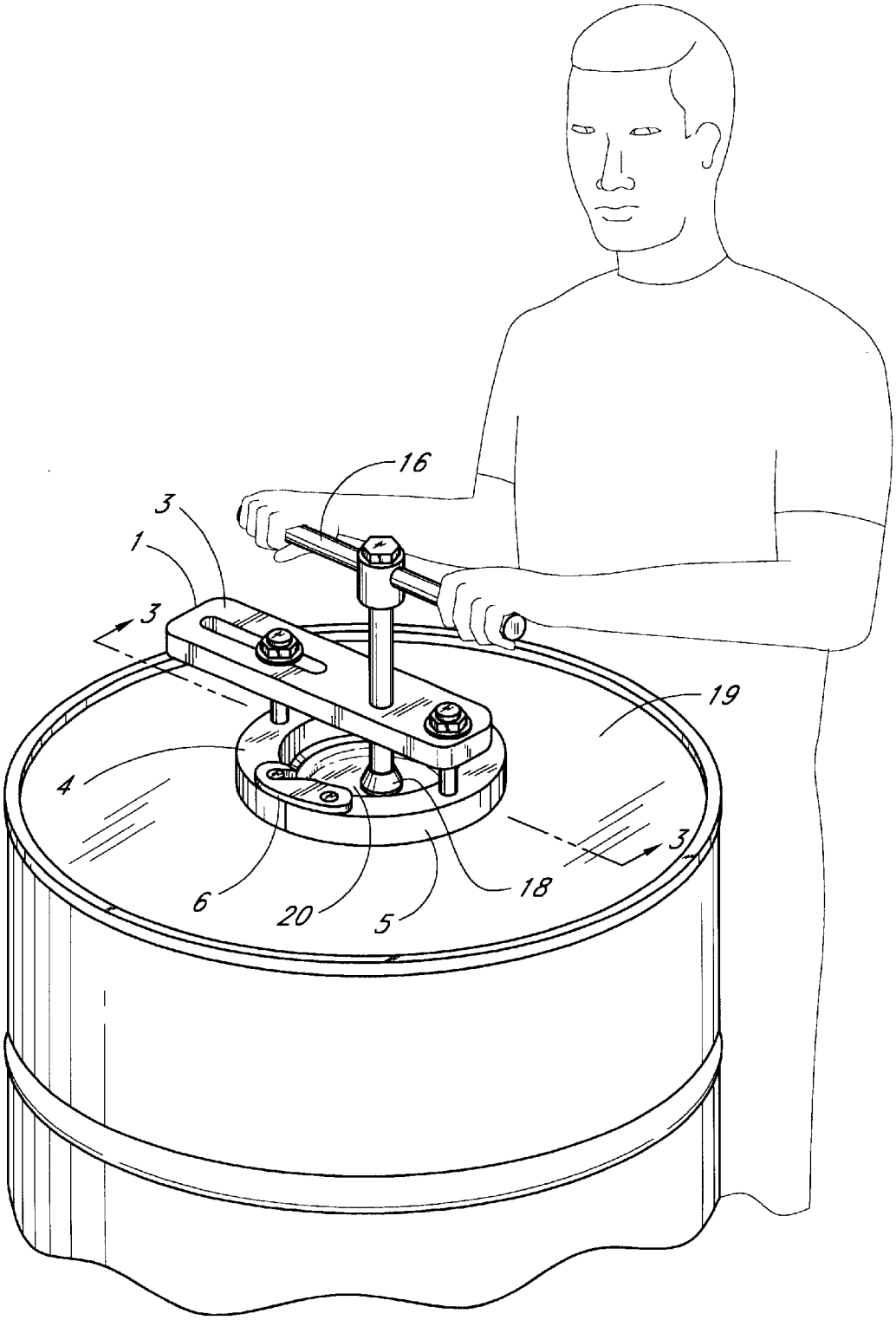
FIG. 2 is a perspective view showing the apparatus in use.
Figure 3:
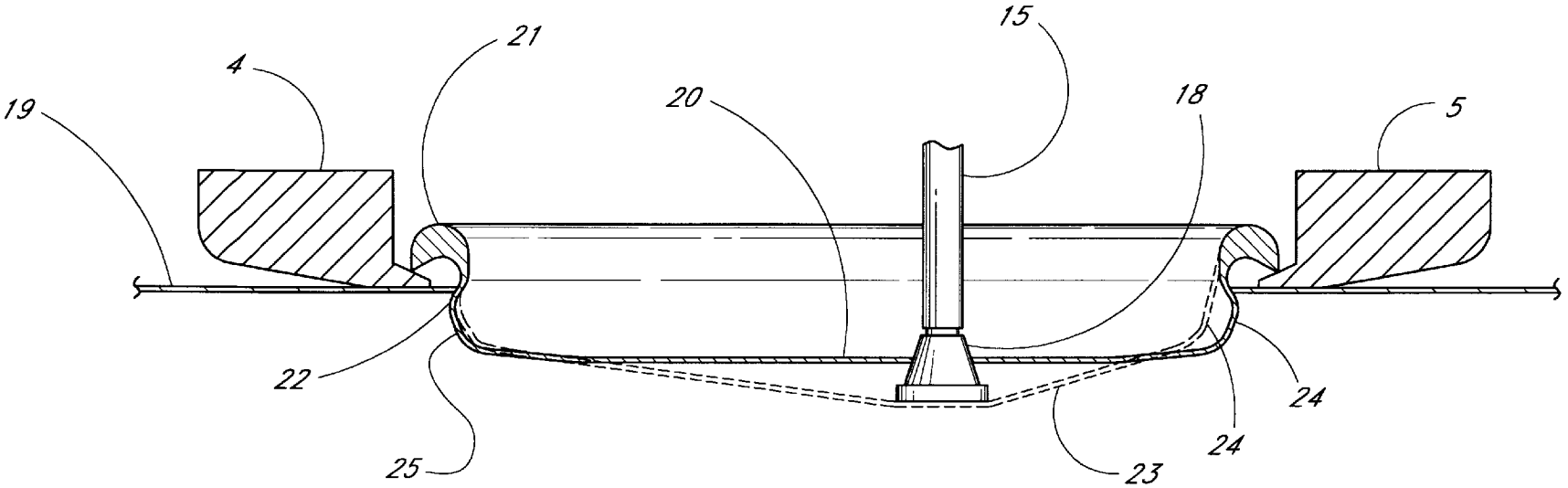
FIG. 3 is a cross-sectional view taken along the line 3—3, shown in FIG. 2.

The apparatus 1 is positioned about a closure 20, which seals an opening in a drum lid 19, in the manner shown in FIG. 1 The components 4, 5 of the clamping mechanism are then closed and the latch 6 engaged, as represented in FIG. 2, to secure the clamping mechanism about a peripheral lip 21 of the opening 22, as represented in FIG. 3. The handle 16 is then turned so as to rotate the shaft 15 and drive the element 18 into engagement with the closure 20. Further rotation of the handle exerts a compression force between the clamping mechanism and the closure, via the load transfer assembly 3, so as to deform the closure 20 inwardly as represented by phantom lines 23.

The element 18 is positioned eccentrically with respect to the opening 22 and closure 20. This leads to the beneficial result of preferential "deformation" of one side 24 of the closure 20, so that the closure is still loosely swaged to the lid 19 over at least a portion 25 thereof to allow the closure 20 to be subsequently lifted clear of the opening, instead of it being forced in its entirety into the interior of the drum.

Figure 4:
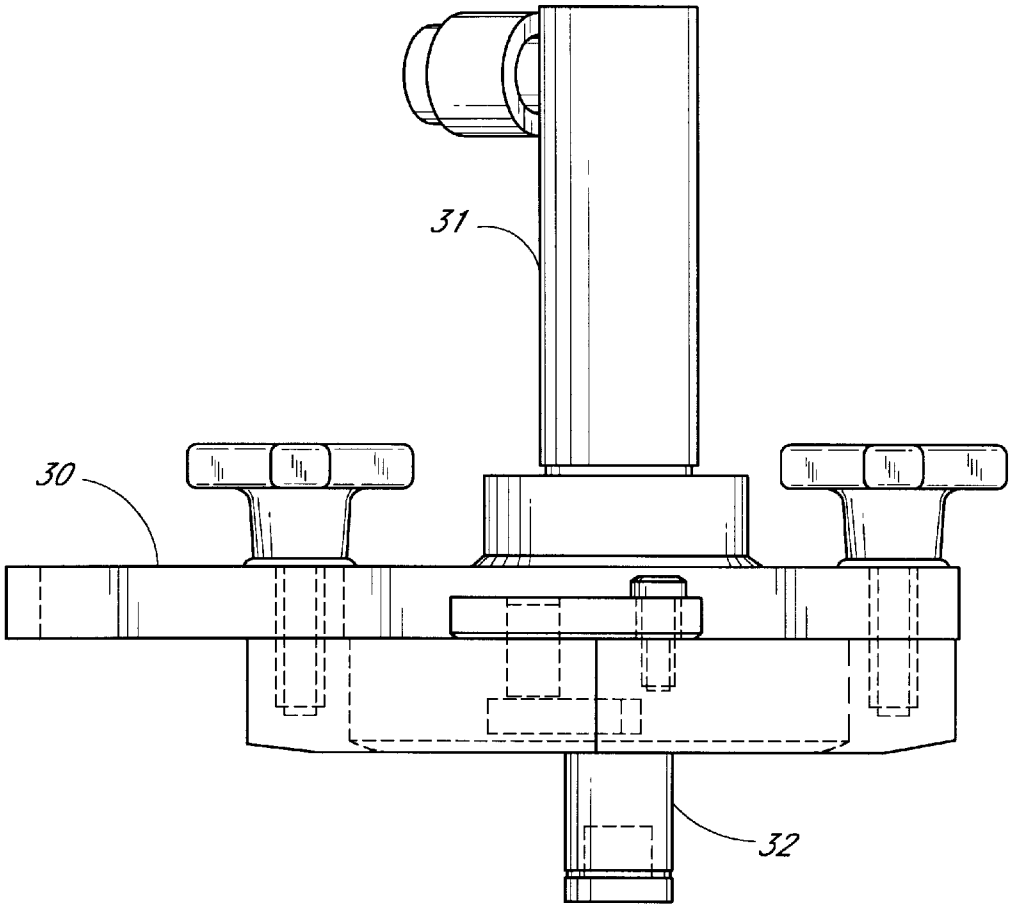
FIG. 4 is a side view of a modified apparatus.

A modified apparatus 30 is shown in FIG. 4. The apparatus 30 functions in a similar manner to apparatus 1. The main difference between apparatus 30 and apparatus 1 is that the turn handle 16 and associated shaft have been replaced with a suitable pneumatic or hydraulic cylinder 31 with a piston arrangement 32, to achieve the same results as detailed above.

As can be appreciated, the "permanent seal" conventionally associated with a centre-fill opening can now be readily and quickly removed, allowing for reuse of the centre-fill opening for a re-filling procedure. Accordingly, the invention provides for significant cost savings in relation to refilling operations of centre fill drums.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

What is claimed is:

1. An apparatus for removing a closure from an opening in a drum, comprising:

a clamping mechanism for securing the apparatus to the drum; and a load transfer assembly coupled to the clamping mechanism and including a drive element engagable with the closure and movable relative to the clamping mechanism to force the closure inwardly of the drum, wherein the clamping mechanism is adapted to fit about the periphery of the opening, and the assembly is arranged so that the drive element is eccentric with respect to the opening.

2. An apparatus as claimed in claim 1, wherein the clamping mechanism includes two hinged components which are adapted to clamp underneath a peripheral lip of the opening.

3. An apparatus as claimed in claim 2, wherein the clamping mechanism includes a latch to releasably secure free ends of the components, when clamped in an operative position, about the opening.

4. An apparatus as claimed in claim 3, wherein the assembly includes slidable engagement with one of the components to allow for free hinged movement of the components between an open condition and an operative condition.

5. An apparatus as claimed in claim 2, wherein the assembly includes slidable engagement with one of the components whereby to allow for free hinged movement of the components between an open condition and an operative condition.

6. An apparatus as claimed claim 2, wherein the clamping mechanism includes at least one arcuate tapered jaw portion, adapted to fit under the peripheral lip of the opening.

7. A method for removing a closure from an opening in a drum, comprising the steps of;

fitting a clamping mechanism to the drum;

exerting a compressive force between the mechanism and the closure, eccentrically of the opening, so as to deform the closure inwardly of the drum; and lifting the closure clear of the opening thereby removing the closure from the opening in the drum.

8. A method as claimed in claim 7, wherein fitting the clamping mechanism to the drum includes clamping hinged components of the mechanism about a peripheral lip of the opening.

* * * * *